United States Patent [19]

Kitamura et al.

[11] Patent Number: 4,765,283

[45] Date of Patent: Aug. 23, 1988

[54] COOLING DEVICE FOR VEHICLE MOUNTED GENERATOR

[75] Inventors: Yutaka Kitamura; Hiroaki Aso, both of Hyogo, Japan

[73] Assignee: Mitsubishi Denki Kabushiki Kaisha, Tokyo, Japan

[21] Appl. No.: 24,199

[22] Filed: Mar. 10, 1987

[30] Foreign Application Priority Data

Mar. 18, 1986 [JP] Japan ..... 61-62068

[51] Int. Cl.[4] ..... F01P 3/20; F01P 7/16

[52] U.S. Cl. ..... 123/41.31

[58] Field of Search ..... 123/41.31; 290/2, 54; 310/54, 58, 61

[56] References Cited

U.S. PATENT DOCUMENTS

| | | | |
|---|---|---|---|
| 3,052,225 | 9/1962 | Kiekhaefer | 123/41.31 |
| 3,089,046 | 5/1963 | Jaeschke | 310/54 X |
| 3,134,371 | 5/1964 | Crooks | 123/41.31 |
| 3,241,331 | 3/1966 | Endress et al. | 310/54 X |

*Primary Examiner*—Tony M. Argenbright
*Assistant Examiner*—Eric R. Carlberg
*Attorney, Agent, or Firm*—Sughrue, Mion, Zinn, Macpeak and Seas

[57] ABSTRACT

A cooling device for cooling a vehicle mounted generator by using an engine coolant of the vehicle includes a temperature sensor 13 for sensing the temperature of the engine coolant, an electromagnetic valve 9 and a control device 14 responsive to the output of the temperature sensor to on-off control the valve such that when the output of the sensor is higher than an upper reference value preset in the control device or lower than a lower reference value preset therein, the valve is closed.

5 Claims, 1 Drawing Sheet

COOLING DEVICE FOR VEHICLE MOUNTED GENERATOR

BACKGROUND OF THE INVENTION

The present invention relates to a cooling device for a vehicle mounted generator which is driven by an engine of the vehicle.

FIG. 1 shows schematically a conventional cooling device for a vehicle mounted generator, which is shown, for example, in Japanese Kokai No. 83557/1984.

In FIG. 1, reference numerals 1, 2, 3, 4, 5, 6 and 7 depict an engine mounted on a vehicle, a cylinder block constituting the engine, a water jacket provided around the cylinder block 2, an upper hose for guiding a coolant heated in the water jacket 3 to a radiator, the radiator, a lower hose for guiding the coolant cooled in the radiator 5 to the water jacket 3 and a water pump provided in between the lower hose 6 and the water jacket 3 for pressurizing the coolant to circulate it forcibly, respectively. An a.c. generator 8 driven by the engine has a bracket through which a portion of the coolant of the engine passes. The portion of the coolant flows through a coolant passage formed in the bracket to cool a stator core and a stator coil of the generator and then flows into the lower hose 6.

In a device constructed as above, a portion of the coolant for the engine 1 flows from the water jacket 3 provided around the cylinder block 2 into the coolant passage formed in the generator 8, and after it cools the stator core and the stator coil of the generator 8 flows into a discharge passage, i.e., the lower hose 6 extending from the radiator 5. The coolant flowing out from the lower hose 6 is subjected to a suction force due to the pump 7. Therefore, the circulation of the coolant flowing through the coolant passage in the generator 8 is maintained favorably, resulting in an effective cooling of the stator core and the stator coil.

In the conventional cooling device mentioned above, when the amount of coolant is reduced due to a breakage, etc. of the radiator 5, the cooling of the engine becomes insufficient, sufficient, so that the temperature of the engine increases abnormally and hence the temperature of the coolant increases abnormally. If the operator of the vehicle does not become aware of this fact, the high temperature coolant or a high temperature coolant gas may be supplied by the water pump 7 to the coolant passage in the generator 8. In such case, the stator core and the stator coil thereof may be cooled insufficiently or not at all and in the worst case they may be heated.

In winter season, the coolant in the coolant passage of the generator 8, even if the amount thereof is reduced, tends to cool the components excessively.

SUMMARY OF THE INVENTION

An object of the present invention is to provide a cooling device for a vehicle mounted generator in which, when the coolant temperature becomes abnormally high or abnormally low, the supply thereof to the generator is terminated such that a thermal influence on generator components to be coole is minimized.

In order to achieve the above object, according to the present invention, the cooling device is provided with a sensor for detecting the temperature of the coolant for the engine of the vehicle and a valve means is provided in a passage for passing a portion of the coolant to the generator. The valve means responds to an output of the sensor to be on-off controlled such that when the temperature of the engine coolant is abnormally high or abnormally low the valve means is closed to cut the coolant supply to the generator to thereby prevent abnormal heating or cooling of the components of the generator to be cooled from occurring.

DETAILED DESCRIPTION OF THE PREFERRED EMBODIMENT

Figure 1:
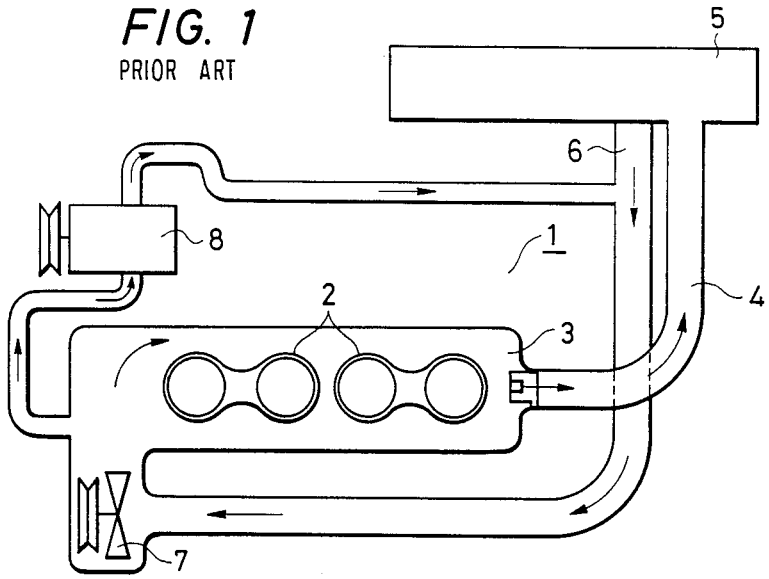
FIG. 1 PRIOR ART
FIG. 1 shows, schematically, a general construction of a conventional cooling device.
Figure 2:
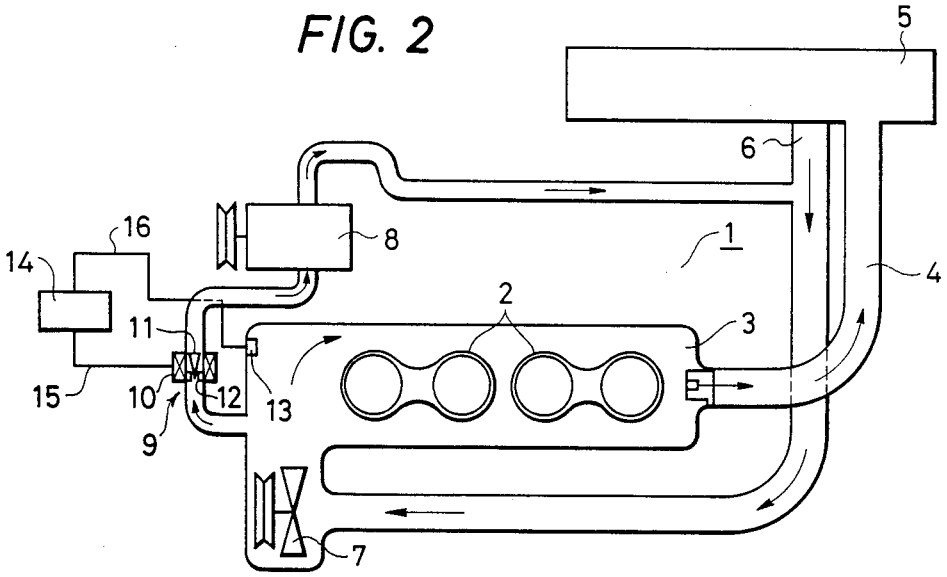
FIG. 2 shows, schematically, a general construction of an embodiment of a cooling device according to the present invention.

FIG. 2 shows a schematic construction of an embodiment of a cooling device for a vehicle mounted generator, according to the present invention. In FIG. 2, an electromagnetic valve 9 is provided in the hose for providing fluid communication between the water jacket 3 of the engine 1 and the generator 8. The electromagnetic valve 9 is composed of a solenoid 10, a movable valve member 11 and a valve seat 12. A temperature sensor 13 is arranged for detecting the temperature of the coolant in the water jacket 3. The present device further includes a control device 14 which receives an output signal from the temperature sensor 13 and compares it with a predetermined value set therein to energize the solenoid 10 when the sensor output reaches the predetermined value to thereby close the valve 9. In the figure, reference numerals 15 and 16 depict an electric connection wire connecting an output of the control device 14 to the solenoid 10 and an electric connection wire connecting the control device 14 to the temperature sensor 13, respectively.

In the cooling device constructed as above, when the radiator 5 of the engine 1 is broken and the amount of coolant is reduced, the temperature of the engine 1 rises and thus the coolant temperature rises abnormally up to around 100° C. The sensor 13 detects such high coolant temperature and provides an output signal through the electric wire 16 to the control device 14. The control device 14 responds to the sensor output and compares it with the predetermined value preset therein. When the output of the temperature sensor 13 exceeds the predetermined value, the control device 14 supplies a drive current to the solenoid 10 to energize the latter. The solenoid 10, when energized, produces a magnetic field of sufficient intensity to move the movable valve member 11 toward the valve seat 12 and to hold it in that state, to thereby keep the valve 9 closed. Therefore, the coolant is prevented from entering into the coolant passage in the generator 8. Thus, it is possible to prevent the components such as the stator core and the stator coil which are to be cooled from being heated by such high temperature coolant, or by high temperature coolant in a gaseous phase.

Although the electromagnetic valve 9 is shown at an intermedial portion of the hose connecting the water jacket 3 and the generator 8 in the described embodiment, it may be arranged in other positions as long as it can block the coolant flow to the generator 8 when the coolant temperature is abnormally high. Such position may be at an entrance of the coolant passage in the generator 8 or at an exit of the water jacket 3 which communicates with the hose.

When the temperature of the coolant in the water jacket 3 is abnormally low, it is also possible to cut the coolant supply to the generator 8 so that the generator components are not cooled too much.

An electrical construction of the control device 14 and the associated components may be easily designed by those skilled in the art and therefore details thereof are not disclosed.

What is claimed is:

1. A cooling device for cooling a vehicle mounted generator (8) with a portion of a liquid coolant of an engine (1) of the vehicle, comprising: temperature sensing means (13) for sensing the temperature of the liquid engine coolant, valve means (9) disposed in a branch coolant flow passage passing through the generator, and control means (14) responsive to the output of the temperature sensing means for controlling said valve means such that said branch coolant flow passage is opened only when the output of said temperature sensing means indicates that the temperature of the coolant is within a predetermined, normal operating range to allow the coolant to pass through the generator, and to thereby avoid the excessive heating or excessive cooling of the generator and thermally sensitive components disposed therein.

2. The cooling device as claimed in claim 1, wherein said control means includes a comparator having predetermined upper and lower reference values, and controls said valve means such that the latter is closed when said output of said temperature sensing means indicates a temperature either higher or lower than said upper or lower reference value, respectively.

3. The cooling device as claimed in claim 2, wherein said valve means is provided at an intermedial position in the branch coolant flow passage between the engine and the generator.

4. The cooling device as claimed in claim 2, wherein said valve means is provided at an entrance of said coolant passage in said generator.

5. The cooling device as claimed in claim 2, wherein said valve means is provided at an entrance of said passage between the engine and the generator.

* * * * *